US005560409A

United States Patent [19]

Knörr

[11] Patent Number: 5,560,409

[45] Date of Patent: Oct. 1, 1996

[54] BACKSAWN TIMBER PRODUCTION FROM RADIALLY SAWN WEDGES

[75] Inventor: Andrew K. Knörr, Devon, Australia

[73] Assignee: Australian Radial Timber Conversion Company (RADCON) Pty Ltd., Yarram, Australia

[21] Appl. No.: 167,842

[22] PCT Filed: Sep. 2, 1992

[86] PCT No.: PCT/AU92/00461

§ 371 Date: Dec. 20, 1993

§ 102(e) Date: Dec. 20, 1993

[87] PCT Pub. No.: WO93/04826

PCT Pub. Date: Mar. 18, 1993

[30] Foreign Application Priority Data

Sep. 3, 1991 [AU] Australia ..... PK8112
Mar. 27, 1992 [AU] Australia ..... PL1554

[51] Int. Cl.[6] ..... B27D 1/00

[52] U.S. Cl. ..... 144/350; 144/346; 144/345; 144/351; 144/367; 144/378; 144/248.7; 156/250; 156/299; 428/58; 428/60; 428/106

[58] Field of Search ..... 144/3 R, 246 R, 144/246 C, 246 D, 246 F, 345, 346, 350, 351, 355, 367, 377, 378; 156/63, 94, 154, 159, 250, 254, 264, 299, 304.1; 428/58, 60, 63, 106, 107, 108, 109, 191, 346

[56] References Cited

U.S. PATENT DOCUMENTS

| | | | |
|---|---|---|---|
| 186,893 | 1/1877 | Springer | 144/378 |
| 781,376 | 1/1905 | Sorensen | 144/346 |
| 3,853,679 | 12/1974 | Ierenzoni | 144/346 |
| 3,903,943 | 9/1975 | Hasenwinkle | 144/367 |
| 3,969,558 | 7/1976 | Sadashige | 144/346 |
| 4,111,247 | 9/1978 | Hasenwinkle | 144/351 |
| 4,538,656 | 9/1985 | Wiklund | 144/378 |

FOREIGN PATENT DOCUMENTS

| | | | |
|---|---|---|---|
| 60861/90 | 2/1991 | Australia . | |
| 852899 | 10/1952 | Germany . | |
| 2754502 | 7/1978 | Germany | 144/378 |

*Primary Examiner*—W. Donald Bray
*Attorney, Agent, or Firm*—Davis, Bujold & Streck, P.A.

[57] ABSTRACT

A method of resawing elongated radially sawn segments of timber so that backsawn boards are produced. Said wedges are sawn with the desired angle between the radial faces and are resawn so that the growth rings of the tree are basically parallel to the broad backsawn faces. The flared radial edges of the boards indicate the growth ring orientation and therefore the cupping tendency and the direction of bow. This enables a greater degree of consistency in the manufacturing process over conventional methods. Said backsawn boards can be used individually as conventional boards with the mentioned advantages or can be laminated together to make a range of laminates that balance or use the bowing and cupping tendency of backsawn timber.

27 Claims, 5 Drawing Sheets

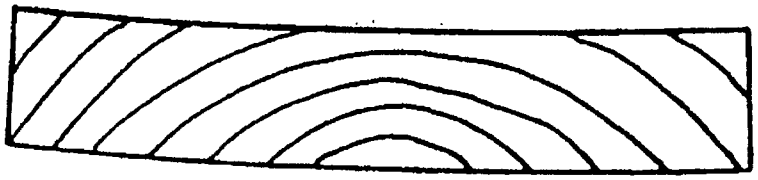
FIG. 2
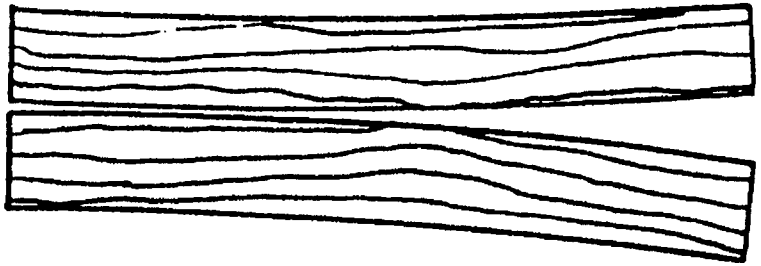
FIG. 3B PRIOR ART
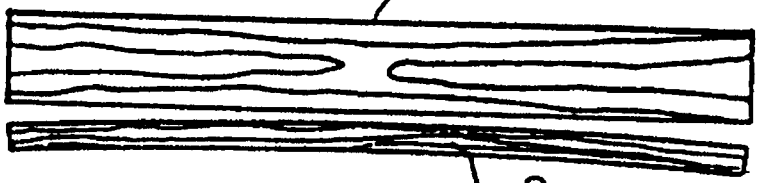
FIG. 4B PRIOR ART
FIG. 4C PRIOR ART
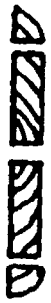
FIG. 3A PRIOR ART
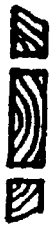
FIG. 4A PRIOR ART

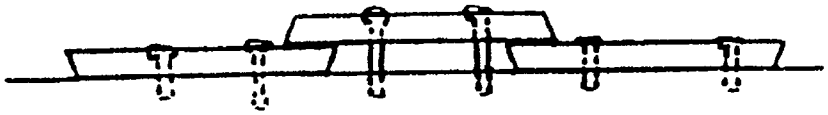
FIG. 8
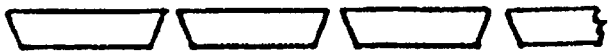
FIG. 9
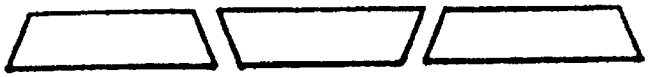
FIG. 10
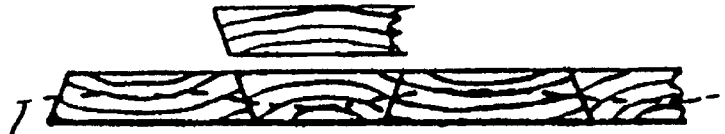
FIG. 11
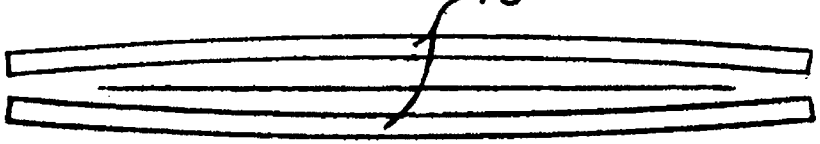
FIG. 12A
FIG. 12B
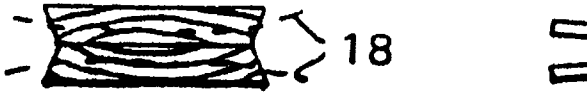
FIG. 12C
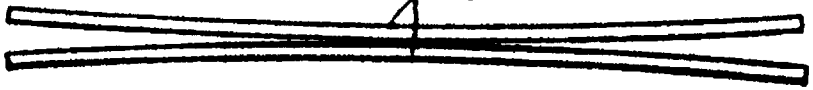
FIG. 12D

BACKSAWN TIMBER PRODUCTION FROM RADIALLY SAWN WEDGES

FIELD OF THE INVENTION

This invention pertains to a method in which radially sawn segments of timber are resawn to produce backsawn timber products, a sawing device for performing the method, and to backsawn products produced therefrom. In particular, a method and device with which production of backsawn timber products with a consistent quality and growth ring orientation, with little waste produced during the production process and with the ability to relieve growth stresses evenly and similarly in each piece of product, is achieved. Even more particularly the method and device involves the resawing of radially sawn wedges of timber so that the cuts made to form the backsawn products are basically tangential to the growth rings of the tree.

BACKGROUND OF THE INVENTION

Present sawing methods generally produce products which do not have consistent quality and growth ring orientation. Present sawing methods produce high degrees of wastage and have difficulty relieving growth stresses similarly in each piece.

Present sawing methods aim to produce a product which is either quartersawn which has the growth rings of the tree basically at right angles to the broad face or backsawn which basically has the growth rings tangential to the broad face.

Present methods for sawing smaller diameter trees with high growth stresses such as species of Eucalyptus generally aim to produce a backsawn product. This involves the cutting of a slab from the side of a log to produce a flat face which would be basically tangential to the growth rings of the tree. This flat face then becomes the "reference" face for further sawing. More sophisticated sawing systems cut two flat faces simultaneously on either side parallel to one another, as shown in FIG. 1A.

Generally further slabs of the desired thickness are cut from the log as at the dotted lines (1) in FIG. 1A. These slabs which are backsawn have the growth stress in the log relieved as bow as at (2) in FIGS. 1B. These slabs are then resawn to the desired width, as in FIG. 3A, as wide boards would be prone be excessive cupping as shown in FIG. 2 as the timber drys. This cupping effect is due to the different shrinkage rates of timber both parallel and at right angles to the growth rings. Timber generally shrinks twice as much parallel to the growth rings as it does at right angles to the growth rings.

A particular slab cut from the log may be wide enough to cut two boards of the desired width but sawing down the middle causes uneven growth ring alignment and stress relieval and causes a combination of spring, as shown in FIG. 3B, and bow and becomes what is generally seen as a low quality piece of timber.

To cut a high quality piece of timber with the stress relieved purely as bow the two edges must be removed as in FIG. 4A. These edges generally go to waste or low value products. The remaining piece of timber has the growth ring alignment of the "perfectly" backsawn piece of timber and will have a degree of bow as shown by (3) in FIG. 4C and will stay "straight" in relation to the broad face if viewed at right angles to the said face as is shown at (4) in FIG. 4B.

A piece of timber of this nature is the aim of backsawn timber production. It is difficult or impossible to produce pieces of timber with this growth ring orientation by conventional means without a high degree of wastage.

SUMMARY OF THE INVENTION

The present invention has for its aim a method of producing consistently backsawn boards. The method involves the resawing of radially sawn wedges of timber so that backsawn boards of the desired thickness are produced.

The stress of the log is relieved in the end product substantially as bow and is consistent in relation to the flared edges and growth ring orientation. As the stress of the tree is contained in the narrow face of the backsawn piece of timber it is comparatively weak and can be easily accommodated for during seasoning or use.

BRIEF DESCRIPTION OF THE DRAWINGS

FIG. 2 is an end view of the prior art board of FIG. 1A showing excessive cupping;

FIG. 3A is an end view of the prior art board of FIG. 1A cut to size;

FIG. 3B is an side view of a wide prior art board cut in the middle showing the resulting bow;

FIG. 4A is an end view of the prior art board of FIG. 1A with the ends cut off to eliminate the bow of FIG. 3B;

FIG. 4B is a top view of the middle piece of the prior art board of FIG. 4A;

FIG. 4C is a side view of the middle piece of the prior art board of FIG. 4A;

FIG. 8 is a diagrammatic view showing a shiplap method of producing a fence using the present invention;

FIGS. 9 and 10 are diagrammatic views showing the use of the present invention for decking;

FIG. 11 is a diagrammatic view of a composite member made by alternating the backsawn faces;

FIGS. 12A and 12C are end views of backsawn boards connected to form a laminate;

FIGS. 12B and 12D are side views of the backsawn boards of FIGS. 12A and 12C, respectively;

DETAILED DESCRIPTION OF THE INVENTION

Figure 1A:
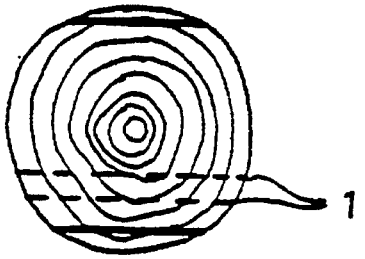
FIG. 1A PRIOR ART
FIG. 1A is end view of a prior art board.
Figure 1B:
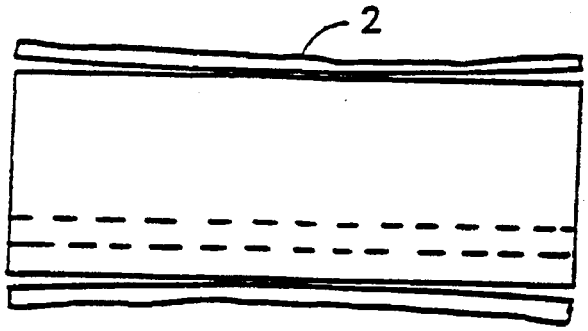
FIG. 1B PRIOR ART
FIG. 1B is a side view of the prior art board of FIG. 1A showing the resulting bow.
Figure 5A:
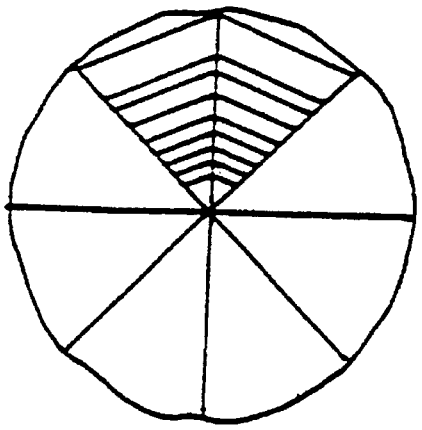
FIGS. 5A and 5B are diagrammatic views of a suitable sawing pattern according to the present invention.
Figure 5B:
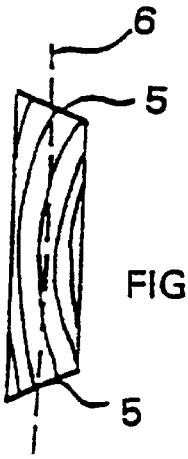

A suitable sawing pattern is illustrated in FIGS. 5A and B. Boards produced by sawing along the lines in FIG. 5A have consistent growth ring orientation in relation to their flared radial edges (5) as shown in FIG. 5B. They appear straight when viewed along the plane parallel to the longitudinal axis and which is at right angles to the broad backsawn faces. The cupping tendency of each board is consistently away from the heart of the tree and is consistent in relation to the flared edges. The plane in which cupping tends to occur is shown by dotted line (6) in FIG. 5B. The effect of the cupping tendency is minimized by cutting such that the width of the broad face is relatively narrow approaching the centre of the log where the growth rings are tightest and relatively wider toward the outside of the log where the growth rings have a relatively larger radius.

Figure 6:
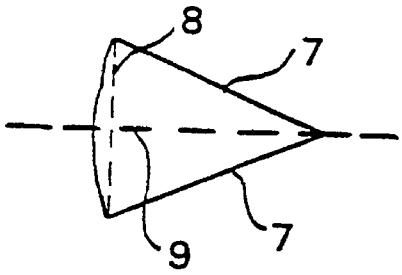
FIG. 6 is a diagrammatic end view of a wedge before resawing.

The said boards are produced by sawing elongated wedged-shaped elements of timber which are produced by sawing a log from the outside to the central core of the log along planes which radially extend through the longitudinal axis, or the decided longitudinal axis of the log. The angle between these planes can be varied to make a wedge-shaped element with the desired angle between the radial faces. FIG. 6 shows a wedge before resawing with radial quartersawn faces (7) and a potential tangential backsawn face at dotted line (8).

Resawing of wedges according to the invention takes place so that the resawn pieces of timber produced are backsawn so that the growth rings of the tree are basically tangential to the two broad resawn faces and so that the growth rings of the tree are basically at right angles to the two narrow flared radial faces of the original wedges. Resawing can take place on the plane shown by dotted line (8) that is at a right angle to the plane shown by the dotted line (9) in FIG. 6 that bisects the angle formed by the two radial faces.

Figure 7:
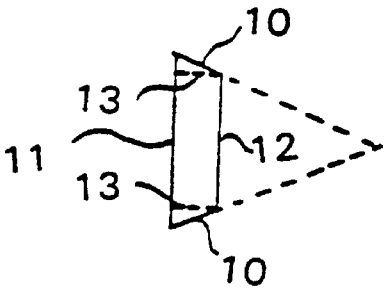
FIG. 7 is a diagrammatic end view of a backsawn board produced according to the present invention.

FIG. 7 shows a backsawn board produced according to the invention with two narrow quartersawn faces (10) forming two narrow flared radial edges (10) which were once essentially the radii of the tree and with two broad backsawn faces, one of which (11) was closest to the outside of the tree and the other (12) which was closest to the centre of the tree.

The backsawn boards produced according to the invention can be used in a variety of ways. The backsawn boards can have both flared edges (10) removed or machined at right angles to the broad faces (11) (12) as at dotted lines (13) in FIG. 7 to produce conventional backsawn boards or the flared edges of the backsawn boards can be machine with any desired profile. Alternatively, the backsawn boards can have only one flared edge removed as at (13) for making a bevelled architrave or the like. An advantage can be gained by orientating the backsawn boards to take advantage of the natural cupping tendency of the boards.

Backsawn boards according to the invention offer consistent backsawn faces which enhance the appearance of many species of timber making them suitable for panelling or featuring walling.

Backsawn boards according to the invention can be used to make a paling type fence with improved characteristics. A shiplap method can be used as in FIG. 8 with the bevelled edges orientated so that they improve the appearance of the fence and so that backsawn faces that were closest to the outside edges of the tree of overlapping boards are facing each other whereby the cupping tendencies of the wood will tend to keep the overlapping join tight.

The inventive backsawn boards can be used as decking with either the flared radial edges facing down as in FIG. 9 or alternating up and down as in FIG. 10 so that adjacent backsawn faces are parallel to one another to give an even appearance. Decking with the flared radial edges facing down would be useful when a wide surface is required and when clearance is wanted for falling objects such as sheep pen flooring.

The resawn boards according to the invention can be connected together flared edge to flared edge with their backsawn faces parallel to one another to make a composite member forming a wide board or sheet of wood. Alternate resawn boards are inverted so that narrow flared radial edges of adjacent boards are parallel to one another when the backsawn faces are parallel to one another. This is illustrated in FIG. 11. Connection in this way gives a growth ring orientation that compensates for the cupping tendency of backsawn boards as shown by dotted line (14). This growth ring orientation also lends the end grain of the composite member a generally wavelike appearance which is a desired objective of conventionally produced backsawn laminates but is hard to achieve to a consistent standard.

The size of consecutive segments can be equal to make composite members with evenly spaced joins or unequal to form unevenly spaces joins.

If laminates are made up of consecutive resawn boards mating mirror images can be worked into the opposing faces to increase the integrity of the laminate. If consecutive boards are to form each layer of the laminate this image can be continued across the composite laminate. This applies as well to subsequently described laminates.

The backsawn boards can be connected to make a range of laminates, such as in FIG. 12A–D in which the cupping tenencies of the boards are balanced. Flared edges and growth rings are connected so that they are facing opposite ways to make a laminate that balances the cupping tenency of one board against the cupping tendency of an adjacent board as at (18) and to likewise balance the bow as at (19). Composite members made in this way have the backsawn faces which were closest to the outside of the tree of one board adjoining backsawn faces that were closest to the outside of the tree of a second board as shown in FIG. 12C. These laminates can be edged or machined to the desired profile as at (20) to make a laminate with square edges or with any desired profile.

Figure 13:
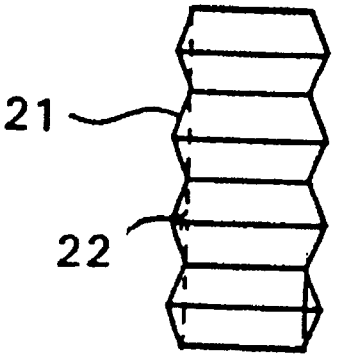
FIG. 13 is a diagrammatic view of a plurality of the backsawn boards of FIG. 12A stacked upon one another.

The above balanced laminates or resawn boards can alternatively be connected to one another backsawn face to backsawn face as in FIG. 13 to make a composite laminate with quarter sawn edges or the edges of the growth rings exposed as at face (21). Alternatively, such a composite laminate could be edged to make a flat face as at dotted line (22), or machined to form a desired profile.

Figure 14:
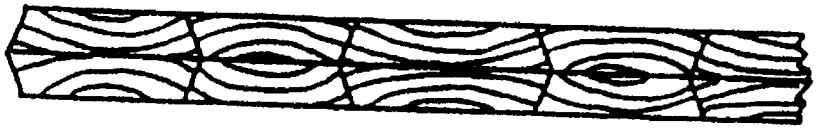
FIG. 14 is a diagrammatic view of a plurality of the backsawn boards of FIG. 12A and 12C connected to one another.

The balanced laminates described above can be connected together so that the convex shape formed by the flared quartersawn edges of an adjacent pair of boards of a first said balanced laminate fit into and connect with the concave shape formed by another pair of adjacent boards in a second balanced laminate as in FIG. 14.

Figure 15:
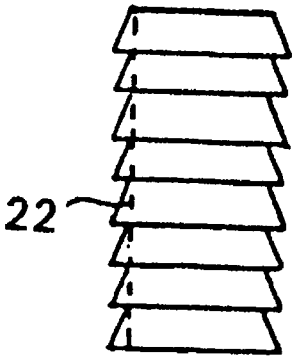
FIG. 15 is a diagrammatic view of a plurality of the backsawn boards stacked upon one another to form a laminate in which all boards face the same direction.

A variation on the balanced laminates can be produced by offsetting the backsawn faces relative to one another. A variation on the balanced laminate can also be produced by aligning said resawn boards of the desired width so that the flared radial edges are all facing in the same direction as in FIG. 15 and so that the backsawn faces that were closest to the outside of the tree are adjoining the face that were closest to the centre of the tree. A laminate such as this could use the tension of the resawn boards to give additional strength to the composite member, by using the bow of the resawn boards to give the member a natural pre-camber.

The composite members described above can be connected by gluing, nailing or other suitable mechanical fastening systems.

Backsawn boards according to the invention can be produced from the elongate wedges by performing single saw cuts either by band or circular saw along the tangential cuts. Once a tangential reference cut has been made wedges can be resawn on a conventional sawbench by holding the tangential reference face up against the gauge and by repeatedly slicing off boards of the required thickness. Multiple cuts can also be made by band saws at the desired spacings set behind one another.

Figure 16:
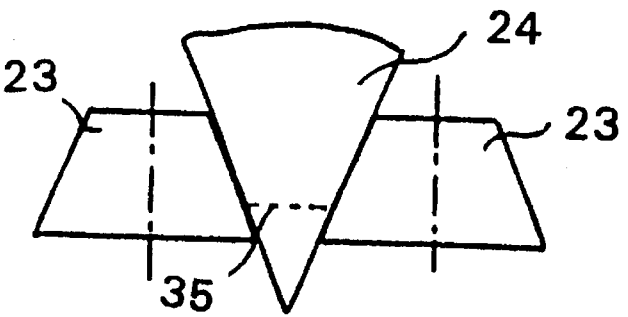
FIG. 16 is a diagrammatic view showing the use of parallel coned rollers referencing the radial sawn wedge.
Figure 17:
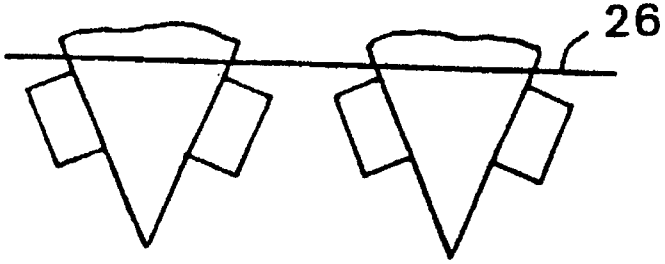
FIG. 17 is a diagrammatic view showing the use of two referencing devices to hold the radial sawn wedge while being cut by a single blade.

The backsawn boards may be resawn from the elongate wedges by placing the wedges in a holding and referencing device that carries or references the wedges by supporting both of the radial faces. The radial faces could be carried on wheels with suitable angles, flat rollers suitably angled, coned rollers, slides or fixed angles. FIG. 16 shows how parallel coned rollers (23) reference the radial sawn wedge (24) and how pressure is applied by a suitable device such as a pressurized roller in the direction of arrow (25) to ensure that the radial faces stay in contact with the coned rollers. In this manner, the coned rollers impart relative movement between the holding and referencing device and the radial wedge to be sawn. More than one holding and referencing device can be placed next to one another as at FIG. 17 so that a single band saw blade (26) can cut more than one elongate wedge at a time. Holding and referencing devices which are fixed in relation to the wedge can be used to cut the spring out of a segment by cutting along a straight plane while rollers or the like which allow relative movement of the wedge can be used to follow the curve in the segment caused by the spring.

Figure 18:
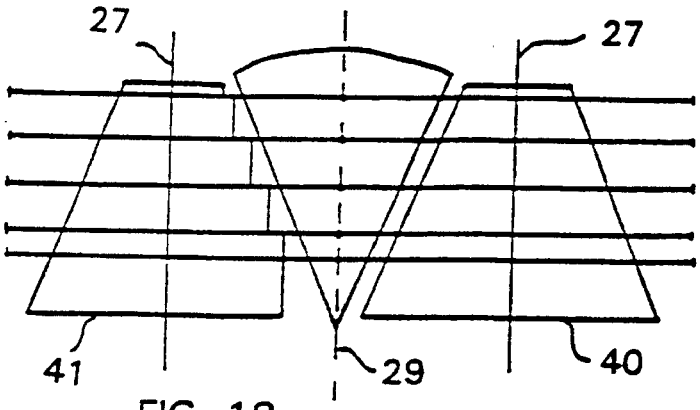
FIG. 18 is a diagrammatic view of the boards being cut by one or more saws mounted on spindles on either side of the wedge.

The boards can be produced from the wedges by one or more saws mounted on spindles on either side (27) of the holding and referencing device and the wedge segment to be resawn as shown in FIG. 18. Cuts are made to the desired depth so that the boards are separated from the adjoining wedge or board. Saws could be synchronized so that the tips of the saws clear one another or the saws could be offset behind one another so that their cutting arcs do not coincide. In this manner the total number of the required cuts can be performed in one lineal motion of the radial segment of timber.

The depth of cut required by each saw decreases as the width of the wedge diminishes towards its apex. Mounting the saw blades in a coned spacer (40) or spacers (41) that increase in diameter as the width of the wedge diminishes as in FIG. 18 allows for the use of the thinner gauged and smaller kerfed saws which minimizes the amount of potentially usable timber turned into sawdust. Parts of the cones or spacers may be planing or machining cutters or hoggers for machining the flared radial edge(s) to a desired profile on the same pass as the sawing cuts.

Figure 19:
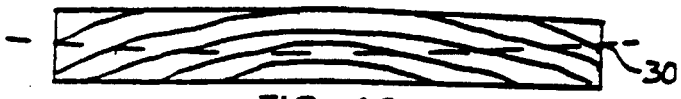
FIG. 19 is an end view of a board after seasoning.

Spindles of the sawing device can be angled the desired amount away from the plane shown by the dotted line (29) that bisects the angle formed by the two radial faces of the segment being cut. In this case the planes made by the saw blades are not parallel and the cuts made by the saws produce a board which is basically convex on the face that was closest to the outside of the tree and is concave on the face that was closest to the centre of the tree. As shown in FIG. 19 which illustrates such a board after seasoning, the natural cupping tendency of the wood (30) can be used to straighten the wood cut in this manner to diminish or remove the convex and concave faces present in the unseasoned backsawn boards during seasoning.

Boards can be sorted according to width by virtue of their radial position in the tree. The increasing width from the inside to the outside of the tree facilitates sorting the boards into groups according to width. These groups of backsawn boards are composed of boards of similar width and length, the number of boards in a group depends on the angle between the radial faces and how many wedges were cut from the log. After being resawn the boards can be conveyed in their wedge group and removed consecutively either starting from the part that was closest to the outside of the tree, from the part that was closest to the centre of the tree or from both sides simultaneously.

Figure 20:
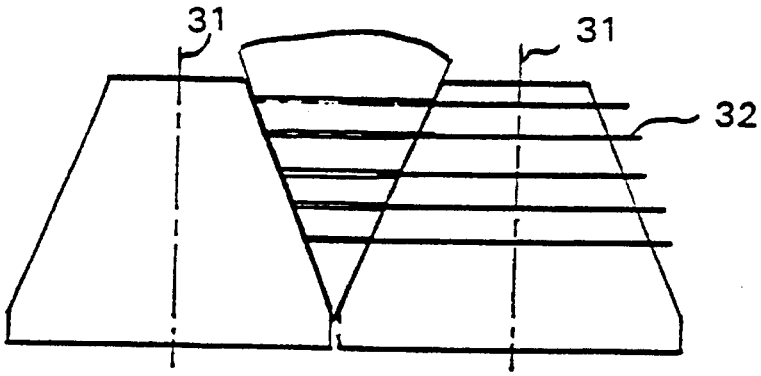
FIG. 20 is a diagrammatic view of a device used for carrying the cut backsawn boards.

A suitable device for carrying the cut backsawn boards is illustrated in FIG. 20. A pair of cones or basically conical device with an angle therebetween corresponding to that of the radial faces of the wedge and which can rotate around their axis shown by dotted line (31) can be used to carry the boards. These cones may be fitted with flanges (32) that fit into the space left by the saw kerf. These flanges can have a tapered edge to provide clearance and guidance for the saw cut. Multiple pairs of such rollers may be arranged in sequence to carry the boards. Flanges can be increased in thickness from one pair to the next to increase the separation between boards for facilitating sorting, transfer and the like. Some or all of the said carrying devices can be power driven.

Figure 21:
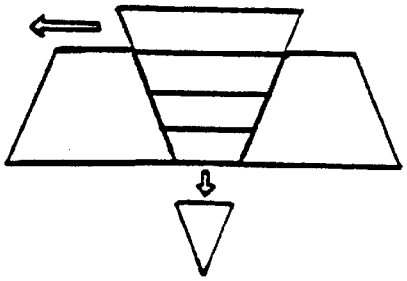
FIG. 21 is a diagrammatic view of a sorting device used to sort the various sizes of the boards.

Rollers or holding devices of diminishing height such as in FIG. 21 may be used to facilitate sorting, either allowing boards to be dropped, swept or lifted as applicable as indicated by arrows in FIG. 21.

Figure 22:
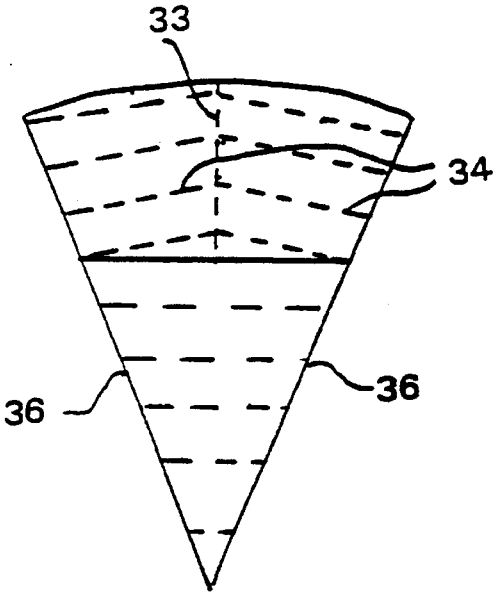
FIG. 22 is a diagrammatic view of the present invention showing the cut lines of a relatively large diameter log.

Radially sawn segments of a relatively large diameter log may be wider than the required width as in FIG. 22. Resawing a backsawn board sawn as described above by simply cutting it in half would lead to the problems associated with growth stresses and growth ring alignment as discussed in relation to FIG. 3.

With a large diameter log the part of the wedge closest to the outside of the tree can be resawn along one or more planes (33) which are essentially radii focused on the point formed on the apex of the wedge. Resawing then takes place in the desired and previously explained manner along dotted lines (34) using the radial faces (33), (35) and (36) as the reference edges.

Large logs with damaged, defective or hollow centres can be efficiently sawn by a similar process, the only difference from sawing a solid log being that, as in the previous method, the radial faces do not come to a physical apex. Dotted line (35) in FIG. 16 shows how a truncated radial wedge with no physical apex can sit and be referenced in the previously described indexing and holding device.

I claim:

1. A process for producing backsawn timber products comprising the steps of:

sawing a log into a plurality of elongate wedges defined by two radial faces having a desired angle therebetween with said radial faces being substantially sawn planar surfaces;

engaging said sawn planar surfaces with a conveying mechanism while sawing each said wedge shaped segment along a plurality of parallel planes extending substantially perpendicular to a reference plane bisecting said desired angle defined by said radial faces, thereby forming a plurality of backsawn boards having two flared radial edges and two parallel backsawn faces; and one of sawing and machining off at least one of said radial edges along a plane extending normal to said backsawn faces, thereby forming at least one edge that is normal to said backsawn faces.

2. A process according to claim 1, comprising the step of one of sawing and machining both said radial edges along planes normal to said faces, thereby forming a backsawn board having a rectangular cross-section.

3. A process according to claim 1, comprising the step of mechanically fastening at least two of said backsawn boards together with mechanical fasteners with at least a portion of faces of the boards that were distant from said center of said log contacting each other face to face, such that a natural cupping tendency of said boards causes the boards to press against said fasteners thereby causing the contacting faces to tightly press against each other.

4. A process according to claim 3, comprising the step of consecutively fastening together a plurality of said boards with the faces of the boards that were distant from the center of said log facing in alternate directions and contacting a portion of a said distant faces of adjacent boards.

5. A process according to claim 1, comprising the steps of arranging a plurality of said boards radial edge to radial edge with faces of said boards that were proximate to a center of said log facing in alternate directions such that adjoining pairs of said radial edges are parallel and said faces of said plurality of boards are arranged in two parallel planes; and connecting said adjoining pairs of radial edges together forming a composite board having two substantially planar parallel faces.

6. A process according to claim 1, wherein when the radially outermost part of said wedges are wider than a desired width of said backsawn boards, comprising the steps of:

sawing the outermost part of each said wedge along at least one radius extending from an apex of said wedge, thereby forming the outer part of each said wedged into elongate truncated wedge shaped segments and leaving the innermost part of each said wedge uncut forming a small wedge shaped segment;

sawing each said small wedge shaped segment along a plurality of parallel planes extending substantially perpendicular to a reference plane bisecting said desired angle defined by said radial faces, and sawing each said truncated wedge shaped segment along a plurality of parallel planes extending substantially perpendicular to a radial reference plane bisecting a respective truncated wedge, thereby forming a plurality of backsawn boards having two flared radial edges and two parallel backsawn faces.

7. A process for producing backsawn timber products comprising the steps of:

sawing a log into a plurality of elongate wedges defined by two radial faces having a desired angle therebetween;

sawing each said wedge shaped segment along a plurality of parallel planes extending substantially perpendicular to a reference plane bisecting said desired angle defined by said radial faces, thereby forming a plurality of backsawn boards having two flared radial edges and two parallel backsawn faces;

one of sawing and machining at least one of said radial edges forming an edge having a desired profile.

8. A process for producing backsawn timber products comprising the steps of:

sawing a log into a plurality of elongate wedges defined by two radial faces having a desired angle therebetween;

sawing each said wedge shaped segment along a plurality of parallel planes extending substantially perpendicular to a reference plane bisecting said desired angle defined by said radial faces, thereby forming a plurality of backsawn boards having two flared radial edges and two parallel backsawn faces;

adhering two said boards together face to face, such that the adhered faces were both one of proximate to a center of said log and distant from the center of said log, thereby forming a laminate out of said two backsawn boards.

9. A process according to claim 8, comprising the steps of forming a first said laminate having the faces that were proximate to the center of the log adhered together;

forming a second said laminate having the faces that were distant from the center of said log adhered together; and mating and connecting together the radial edges on a side of said first laminate with the radial edges on a side of said second laminate thereby forming a composite of both said laminates.

10. A process for producing backsawn timber products comprising the steps of:

sawing a log into a plurality of elongate wedges defined by two radial faces having a desired angle therebetween;

sawing each said wedge shaped segment along a plurality of parallel planes extending substantially perpendicular to a reference plane bisecting said desired angle defined by said radial faces, thereby forming a plurality of backsawn boards having two flared radial edges and two parallel backsawn faces;

transporting said elongate wedges with a transporting device comprising a pair of rollers whose faces define a wedge shaped support surface corresponding in size and shape with said radial faces of said wedges.

11. A process according to claim 10, wherein said rollers are conical rollers.

12. A process according to claim 10, comprising the steps of:

transporting said elongate wedges past a sawing station and sawing said wedges with at least two sets of circular saw blades having a desired separation between adjacent pairs of blades and being arranged to cut the wedges from opposite sides thereof to a depth sufficient to separate said boards; and mounting said sets of saw blades on spindles and arranging said spindles such that their axis of rotations are not parallel to said plane that bisects said desired angle between said radial faces, such that faces, of backsawn boards cut by said blades, that were proximate a center of said log have a concave shape and faces, of said boards cut by said blades, that were distant from the center of said log have a convex shape in order to counter a natural cupping tendency of said backsawn boards.

13. A process according to claim 10, comprising the steps of:

transporting said elongate wedges past a sawing station and sawing said wedges with at least one set of circular saw blades having a desired separation between adjacent pairs of blades in order to cut said wedges along said plurality of parallel planes; and mounting said saw blades in one of a conical and stepped chuck having a contour that mirrors a radial face of said wedges so that the thinnest possible saw blades are used to cut said wedges thereby minimizing waste.

14. A process according to claim 13, comprising the step of producing a desired profile on at least one edge of said backsawn boards by providing one of cutting, machining and hogging devices in the separation between adjacent saw blades.

15. A process according to claim 13, comprising the step of transporting said sawn wedges from said sawing station with conical rollers having radial faces that mate with the radial faces of said wedges and wherein said conical rollers are fitted with substantially flat disc shaped flanges that fit into spaces in the wedges made by said saw blades.

16. A process for producing backsawn timber products comprising the steps of:

sawing a log into a plurality of elongate wedges defined by two radial faces having a desired angle therebetween: and sawing each said wedge shaped segment along a plurality of parallel planes extending substantially perpendicular to a reference plane bisecting said desired angle defined by said radial faces, thereby forming a plurality of backsawn boards having two flared radial edges and two parallel backsawn faces; and one of sawing and machining at least one of the radial edges so that at least part of one of the radial edges is one of normal to and forms an acute angle with the backsawn face that was proximate to center of said log.

17. A process according to claim 16 further comprising the step of one of sawing and machining at least a portion of each of said radial faces so that at least a portion of the said one of sawn and machined faces are substantially parallel to one another.

18. A process according to claim 16 comprising the step of one of sawing and machining both said radial edges along planes normal to said faces, thereby forming a backsawn board having a rectangular transverse cross-section.

19. A process according to claim 16 further comprising the step of one of sawing and machining the radial edges to a desired profile.

20. A process according to claim 16 comprising the step of adhering at least two of said boards together face to face, such that the adhered faces are both one of proximate to the center of said log and distant from the center of said log.

21. A process according to claim 16 comprising the step of adhering at least two of the said boards so that a face which is proximate to the center of said log is adhered to a face which is distant from the center of said log.

22. A process according to claim 16 further comprising the step of using the radial edges to determine the cupping tendency of said backsawn board.

23. A process according to claim 16 further comprising the step of one of sawing, machining and orienting said board in order to one of maximize and minimize an effect of cupping tendency.

24. A process according to claim 16 further comprising the step of drying said backsawn board prior to one of sawing and machining.

25. A process according to claim 16 further comprising the step of sorting the boards into groups by virtue of each boards' relative position in said wedge.

26. A process according to claim 16 wherein said step of radially sawing a log comprises radially sawing a log along a plurality of radially extending planes intersecting along a central longitudinal axis of said log, and said planes are evenly arranged around a circumference of said log such that adjacent pairs of said planes define said desired angle therebetween.

27. A process according to claim 16 further comprising the step of transporting said elongate wedges past a sawing station and sawing said wedges with at least two sets of circular saw blades having a desired separation between adjacent pairs of blades and being arranged to cut the wedges from opposite sides thereof to a depth sufficient to separate said boards, thereby producing a desired profile on at least one edge of said backsawn boards by providing one of cutting, machining and hogging devices in the separation between adjacent saw blades.

* * * * *